US005842848A

United States Patent [19]

Knowles

[11] Patent Number: 5,842,848

[45] Date of Patent: Dec. 1, 1998

[54] COMPACT HIGH-VOLUME GEAR PUMP

[76] Inventor: Frederick W. Knowles, 50 Cornell Rd., Marblehead, Mass. 01945

[21] Appl. No.: 778,451

[22] Filed: Jan. 3, 1997

[51] Int. Cl.[6] ..... F04C 2/18

[52] U.S. Cl. ..... 418/196

[58] Field of Search ..... 418/196

[56] References Cited

U.S. PATENT DOCUMENTS

| | | | |
|---|---|---|---|
| 1,460,875 | 7/1923 | White | 417/308 |
| 1,835,977 | 12/1931 | Ernst et al. | 60/429 |
| 2,042,247 | 5/1936 | Blood | 60/375 |
| 2,094,526 | 9/1937 | Carlson | 60/444 |
| 2,354,992 | 8/1944 | Gottlieb | 418/196 |
| 2,518,782 | 8/1950 | Hipp | 60/429 |
| 2,589,528 | 3/1952 | Bergsma | 418/196 |
| 2,681,621 | 6/1954 | Hedman | 418/196 |
| 2,728,300 | 12/1955 | Stoermer | 418/196 |
| 2,960,828 | 11/1960 | Gould | 60/368 |
| 3,360,925 | 1/1968 | Zimmerman | 60/433 |
| 3,443,380 | 5/1969 | Karazija | 60/421 |
| 3,478,694 | 11/1969 | Morando | 418/206.1 |
| 3,540,218 | 11/1970 | Finn | 60/430 |
| 3,811,282 | 5/1974 | Schexnayder | 60/421 |
| 4,245,964 | 1/1981 | Rannenberg | 417/287 |
| 4,290,736 | 9/1981 | Bernasconi | 418/206.1 |

FOREIGN PATENT DOCUMENTS

| | | | |
|---|---|---|---|
| 0042774 A1 | 12/1981 | European Pat. Off. | 417/426 |
| 0091347 A1 | 10/1983 | European Pat. Off. | 418/200 |
| 884344 | 4/1943 | France | 418/196 |
| 2545778 A1 | 4/1977 | Germany | 60/429 |
| 3524790 A1 | 1/1987 | Germany | 417/429 |
| 56-60888 | 5/1981 | Japan | 417/426 |

*Primary Examiner*—John J. Vrablik

[57] ABSTRACT

A compact high-volume pump having a unitary body member with a plurality of cavities each containing a rotatable gear, each gear being powered by a single rotatable gear. Each of the cavities is provided with a separate inlet port and separate outlet port and may be employed to perform a plurality of separate pumping functions.

11 Claims, 4 Drawing Sheets

COMPACT HIGH-VOLUME GEAR PUMP

BACKGROUND OF THE INVENTION

The present invention relates to gear pumps, and more particularly to a compact high-volume pump of that type.

There are a great number of pump configurations known in the art in which the fluid is pumped by a plurality of intermeshing gears contained within a casing, to provide a high volume of fluid over a short time interval. The casing generally has a single inlet and outlet, and a plurality of gears are employed to produce the pumping pressure, the fluid being contained within the casing during the pressure buildup.

While these various pumps have proved satisfactory in most applications, there are many devices or assemblies of machinery which employ pumps of this type wherein a number of uses are found for the employment of pumps of this type. In many instances the pump may be employed for hydraulic pressure at one or more points in the device, and also may be needed for the cooling of components at other functions of the particular device. In such devices it may be required to employ a number of pumps operated from a single belt assembly or to provide a number of pumps on a single shaft to accomplish the desired result. This, however, may prove to be unsatisfactory where the device is intended to be mobile and, therefore, must be compact and lightweight.

It is, therefore, an object of the present invention to provide a compact high-volume pump having the ability to provide fluid at a number of locations during its operation.

Another object of the invention is to provide a compact high-volume pump of the type described which is lightweight and versatile in operation.

A further object of the invention is to provide a compact high-volume pump of the type set forth above which contains a minimum number of components and is simple to manufacture and assemble.

SUMMARY OF THE INVENTION

The above objects and other objectives which will become apparent as the description proceeds are accomplished by providing a compact high-volume gear pump which has a unitary body member having a central cavity with a drive gear disposed in the cavity. A plurality of individual cavities are disposed about the central cavity and a planetary gear is disposed in each of the individual cavities, each planetary gear being in meshing engagement with the drive gear. An elongated opening is formed in the body member adjacent each the planetary gear members for outflow of fluid from the planetary gear member cavity and a separate means is provided for directing inflow of fluid into each of the individual cavities.

A plurality of separate conduits are formed in the body member and each of the conduits extend from a respective elongated opening to an outermost surface of the body member to provide flow of fluid to an outside source from the particular planetary gear disposed in its individual cavity.

A cap member may be provided having a surface in facing relation with the body member cavities, the cap member being provided with separate means for directing inflow of fluid into each of the individual cavities. The means for directing inflow of fluid generally comprises an arcuate opening formed in the cap member surface which is disposed adjacent each of the cavities.

Generally, the planetary gear in each of the cavities has opposed face surfaces, one of the face surfaces being disposed adjacent an elongated outflow while the other opposed face surface is disposed adjacent the arcuate opening in which the fluid is received.

BRIEF DESCRIPTION OF THE DRAWING

The foregoing features and other features of the invention will be more particularly described in connection with the preferred embodiment, and with reference to the accompanying drawing wherein.

DESCRIPTION OF THE PREFERRED EMBODIMENT

Figure 1:
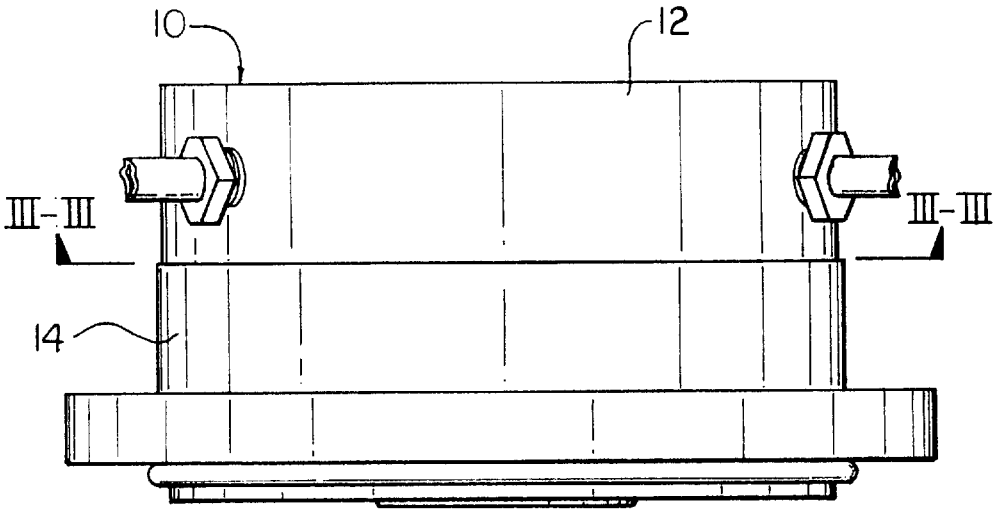
FIG. 1 is an elevational view showing a compact high-volume pump constructed in accordance with the teachings of the present invention.
Figure 2:
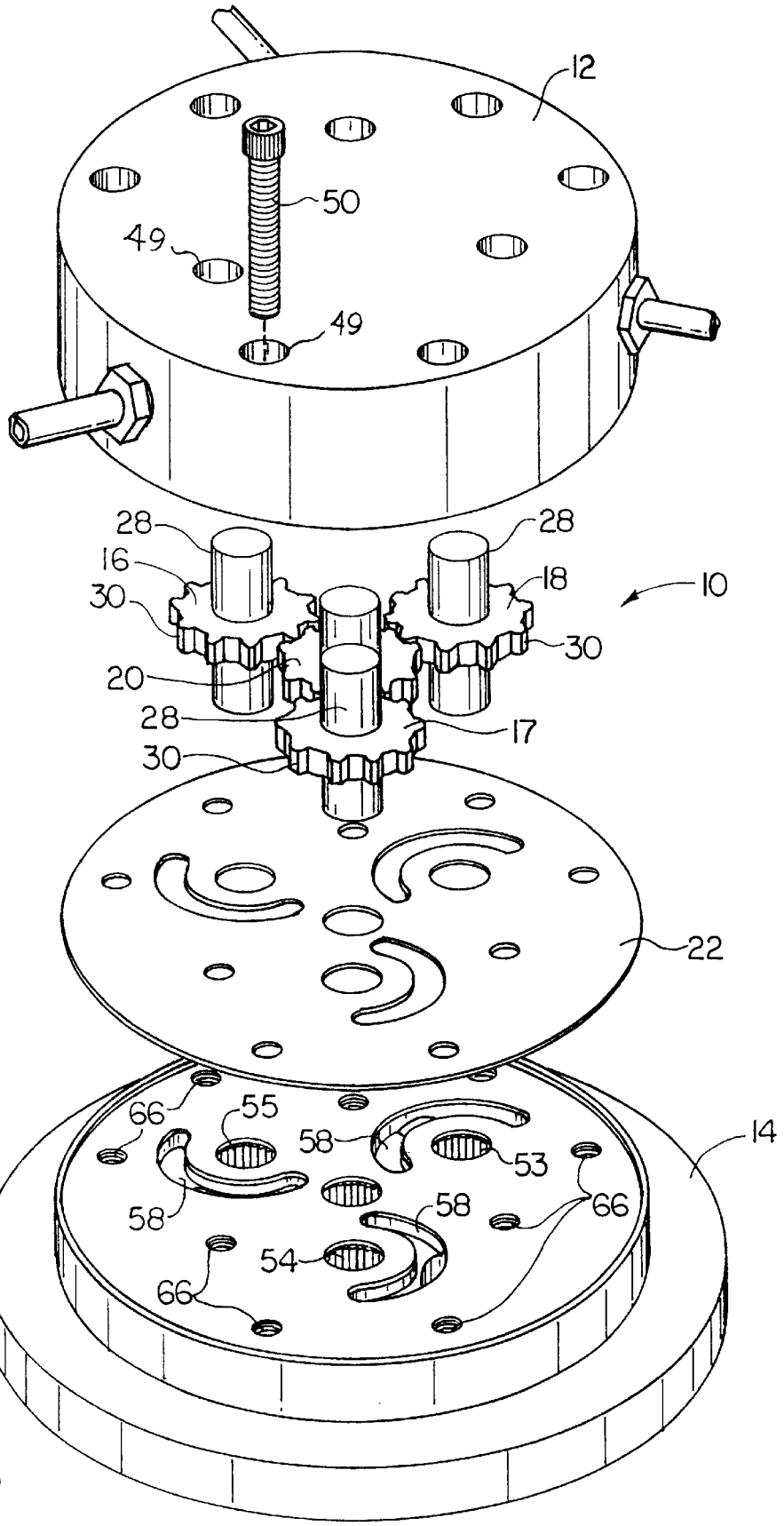
FIG. 2 is a perspective exploded view of the structure of FIG. 1 showing the various components of the compact high-volume pump in detail.

Referring now to the drawing and in particular to FIGS. 1 and 2, there is shown a compact high-volume pump 10 comprising a body 12, cap 14 and a plurality of planetary gears 16, 17 and 18 disposed about a drive gear 20. A thin gasket 22 is mounted between the body 12 and cap 14 for sealing purposes when the pump 10 is formed into the assembly shown in FIG. 1.

Figure 3:
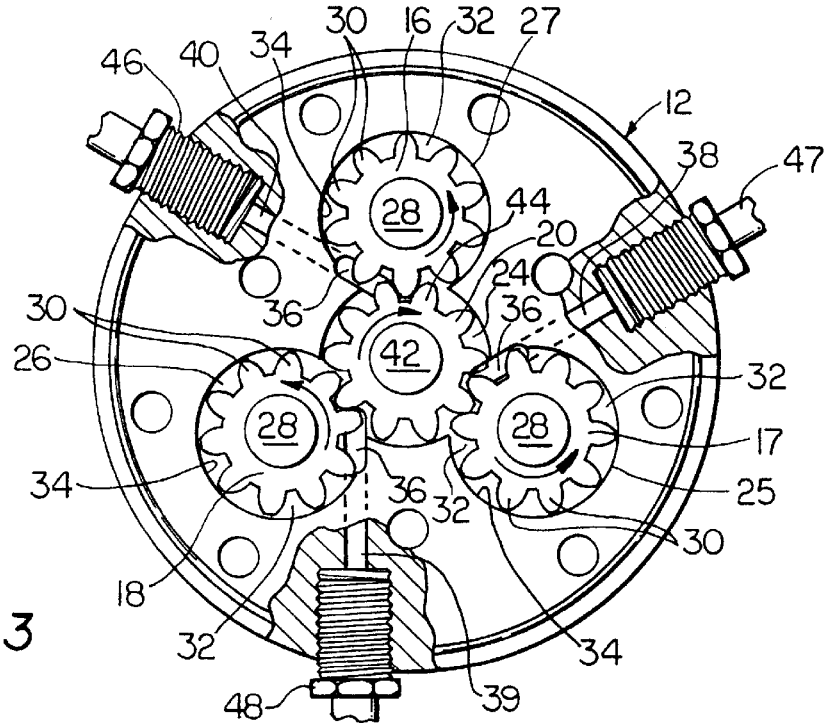
FIG. 3 is a plan view taken along the part line III—III of FIG. 1 having portions broken away for clarity and showing the body member of the structure of FIGS. 1 and 2 in detail.
Figure 4:
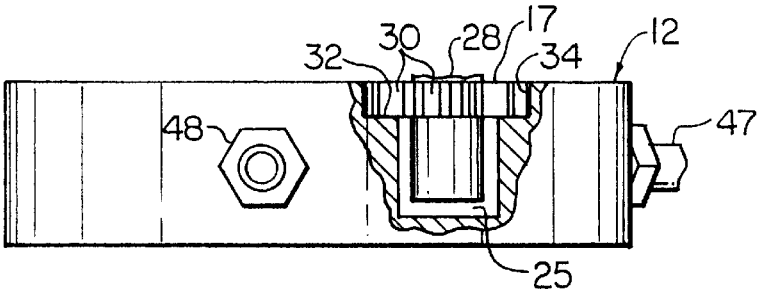
FIG. 4 is an elevational view of the structure of FIG. 3 having portions broken away for clarity.
Figure 5:
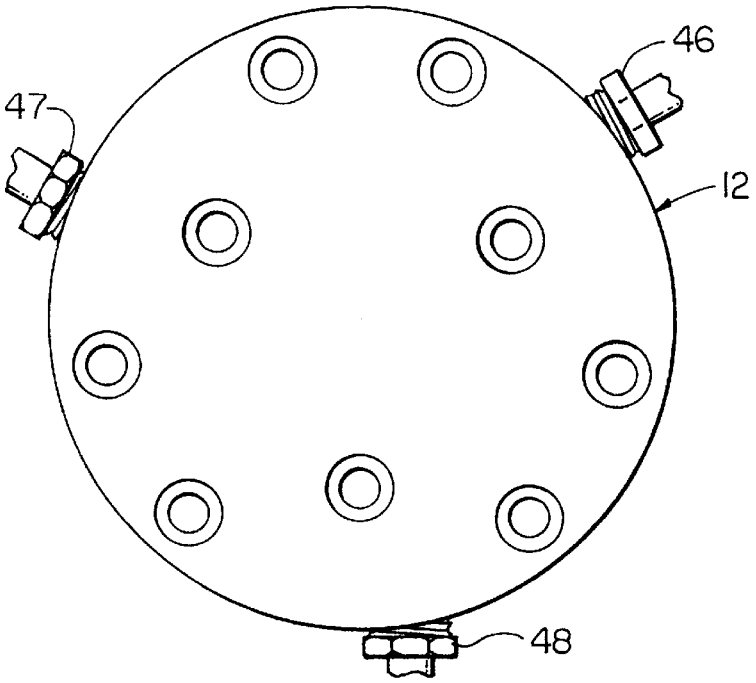
FIG. 5 is a plan view of the structure of FIG. 4 showing details of the surface opposite to that shown in FIG. 3.

As best shown in FIGS. 3, 4 and 5 (taken in conjunction with FIG. 2), the body 12 is formed of a cylindrical unitary member having a central cavity 24 and three individual cavities 25, 26 and 27 formed about the central cavity, and opening into the central cavity. The planetary gears 16, 17 and 18 may be interchangeably received in either the cavities 25, 26 or 27, each having a support shaft 28 and a plurality of gear teeth 30 which are employed in the pumping process.

As each of the gears 16, 17, and 18 are interchangeable in the cavities 25, 26 or 27, which are substantially identical in dimension, only the cavity 25 is shown at FIG. 4, and will be described in detail. In FIG. 4 it will be seen that the planetary gear 17, which is supported in the cap 14 (which will be described in detail as the description proceeds), is disposed with the support shaft 28 extending into the cavity 25. The gear teeth 30 contact a support surface 32 which terminates in a cylindrical surface 34 of a fractionally greater diameter than the diameter of the gear teeth 30. In each of the cavities 25, 26 and 27 an elongated opening of similar depth to that of the cavities 25, 26 and 27 is formed extending inwardly into the body 12 and opening in the support surface 32 adjacent the outer ends of the gear teeth. Separate conduits 38, 39 and 40 are formed in the body 12 to provide fluid outflow from a respective cavity 25, 26 and 27, during the pumping operation.

Referring now to FIG. 3, the drive gear 20 is mounted on a central drive shaft 42 and has a plurality of gear teeth 44 to drivingly engage each of the gear teeth 30 on the planetary gears 16, 17 and 18.

As is shown in FIG. 3, the conduits 38, 39 and 40 lead to an external threaded portion of the body 12 in which may be received a fitting 46, 47 or 48, as shown, or may be individually capped when not in use. Incoming fluid from fittings 46, 47 and 48 enter body 12 through conduits 38, 39 and 40. From these conduits the fluid enters tangentially through elongated openings 36 into individual cavities 25, 26 and 27 adjacent support surface 32. A plurality of openings 49 are provided in the body 12 to receive fastening means in the form of cap screws 50 (one of which is shown in FIG. 2) for retaining the cap 14 onto the body 12.

Figure 6:
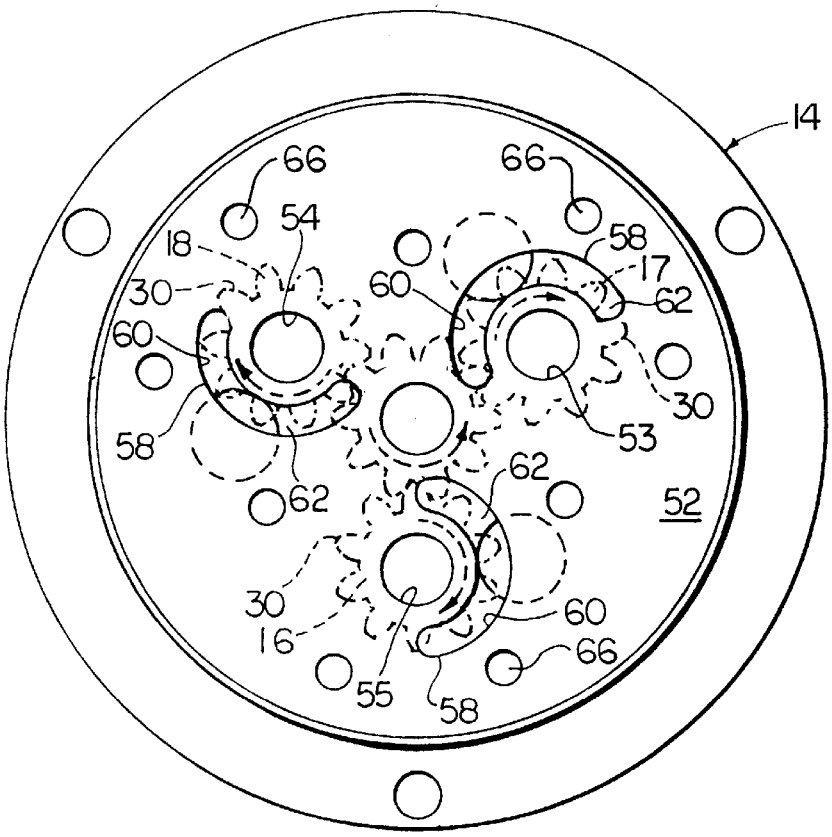
FIG. 6 is a plan view of the cap member of the structure shown in FIGS. 1 and 2 showing the mating surface to that of the surface shown in FIG. 3, portions of the structure of FIG. 3 being depicted in phantom lines.
Figure 7:
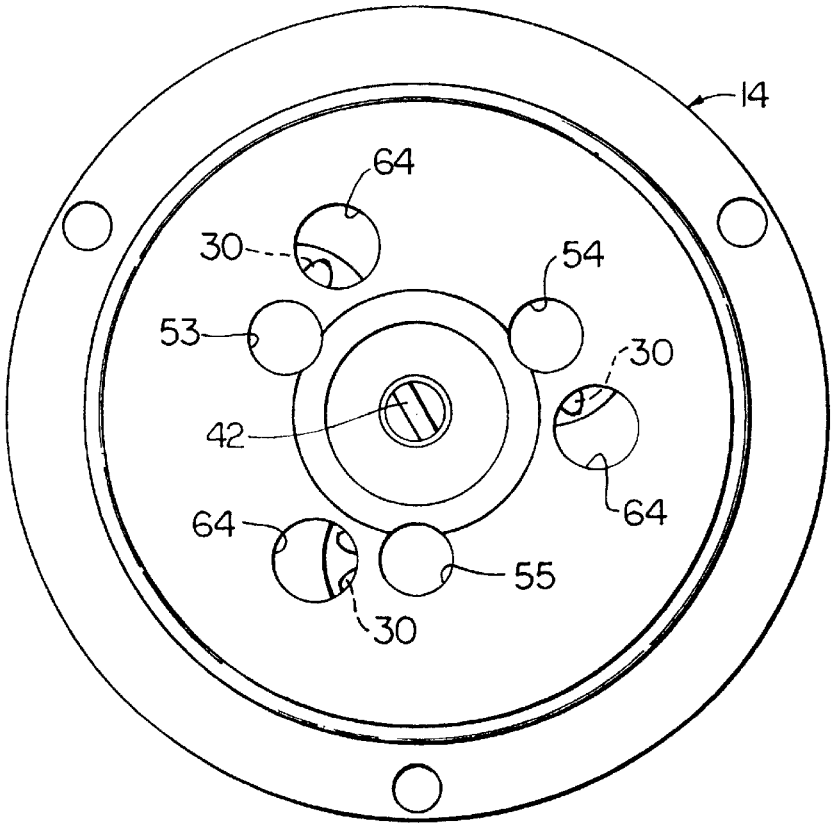
FIG. 7 is a plan view of the structure of FIG. 6 showing the opposite surface of that structure in detail.

Referring now to FIGS. 6 and 7, taken in conjunction with FIG. 2, the cap 14 is shown to have a mating surface 52 having three bores 53, 54 and 55 formed therein for receiving a respective shaft of a planetary gear 16, 17 or 18. Each of the bores 53, 54 and 55 contains a roller bearing (shown in FIG. 2) pressed into the respective bore which serves to support a respective support shaft 28. In FIG. 6 it will be observed that an individual arcuate opening 58 is provided extending into the cap 14 at each of the locations where the teeth 30 of a respective planetary gear 16, 17 or 18 are disposed adjacent the surface 52. The arcuate opening 58 has an outer surface 60 in alignment with a cylindrical surface 34 of a respective planetary gear 16, 17 or 18 and extends into the cap 14 to a wall 62 perpendicular to the rotational axis of the planetary gear 16, 17 or 18. As shown in FIG. 7, a circular bore 64 extends through the outer surface opposite the surface 52 of the cap 14 and intersects with the arcuate opening 58 at the wall 62 to provide inflow of material to each of the planetary gears 16, 17 or 18. A suitable fitting may be applied to a single bore 64, or to accommodate all three bores 64, as required by a particular application.

Referring to FIG. 2, the gasket 22 is shown to be provided with identical openings corresponding to those of the cap 14, and is employed between the body 12 and the cap 14 when the two are assembled. The gear teeth 30 of each of the planetary gears 16, 17 and 18 are in contact with the gasket 22, which is formed of a metallic material to be wear resistant.

As shown in FIG. 6 and FIG. 2, a plurality of threaded openings 66 are provided in the cap 14 for receiving the cap screws 50 for forcing the cap and body members into sealing engagement in the assembly.

In operation, the fluid entering each of the circular bores 64 in the cap 14 is introduced into an individual cavity 25, 26 or 27 through the arcuate opening 58 while the drive gear 20 is being rotated by external means, such as an electric motor or diesel engine, depending on the particular service requirement of the pump. As the fluid flows into the reservoir formed by the outer surface 60 and walls 62 of an arcuate opening 58, it is pumped by the gear teeth 30 of a respective planetary gear 16, 17 or 18 and forced into the elongated opening 36 and outwardly through a conduit 38, 39 or 40.

Each of the individual planetary gears 16, 17 and 18, in combination with its respective cavity 25, 26 or 27, forms an individual pump which may be employed through the separate conduits 38, 39 or 40 to perform a separate function, or a particular conduit may be capped when not in use.

Thus, the compact high-volume pump 10, while containing a minimum number of parts, is capable of performing a plurality of functions during its operation, and is of a size which is readily portable and easy to dissemble and repair should such be required.

While it is apparent that changes and modifications can be made within the spirit and scope of the present invention, it is my intention, however, only to be limited by the appended claims.

As my invention I claim:

1. A compact high-volume gear pump comprising:

a unitary body member, said body member having a central cavity and at least two individual cavities opening into said central cavity;

a cap member having a surface in facing relation with the cavities in said body member;

a drive gear disposed in said central cavity;

a planetary gear disposed in each of said individual cavities, each planetary gear being in meshing engagement with said drive gear, said drive gear and said planetary gears each having substantially the same diameter;

a separate means for directing inflow of fluid into each said individual cavity, said separate means for directing inflow of fluid into each said individual cavity comprising an arcuate opening formed in said cap member surface disposed adjacent each said cavity and extending along the periphery of each planetary gear; and a separate elongated opening formed in said body member adjacent each of said planetary gear members for outflow of fluid from the respective individual planetary gear cavity.

2. A compact high-volume gear pump as set forth in claim 1 wherein each said planetary gear has a pair of opposed face surfaces and said respective elongated opening is disposed adjacent one of said opposed face surfaces.

3. A compact high-volume gear pump as set forth in claim 1 which includes a plurality of separate conduits formed in said body member, each of said conduits extending from a respective elongated opening to an outermost surface of said body member.

4. A compact high-volume gear pump as set forth in claim 1 wherein each said planetary gear has a pair of opposed face surfaces, said respective elongated opening being disposed adjacent one of said opposed face surfaces and said arcuate opening being disposed adjacent the other of said opposed face surfaces.

5. A compact high-volume gear pump as set forth in claim 1 wherein said plurality of individual cavities is three in number.

6. A compact high-volume gear pump as set forth in claim 1 wherein said body member is cylindrical in form.

7. A compact high-volume gear pump as set forth in claim 2 which includes a plurality of separate conduits formed in said body member, each of said conduits extending from a respective elongated opening to an outermost surface of said body member.

8. A compact high-volume gear pump as set forth in claim 7 which further includes;

a cap member having a surface in facing relation with said body member cavities and wherein said separate means for directing inflow of fluid into each said individual cavity comprises an arcuate opening formed in said cap member surface disposed adjacent each said cavity.

9. A compact high-volume gear pump as set forth in claim 8 wherein each said arcuate opening is disposed adjacent a gear face surface opposite that of said surface facing said elongated opening.

10. A compact high-volume gear pump as set forth in claim 9 wherein said plurality of individual cavities is three in number.

11. A compact high-volume gear pump as set forth in claim 10 wherein said body member is cylindrical in form.

* * * * *